US005402565A

United States Patent [19]

Farmer

[11] Patent Number: 5,402,565

[45] Date of Patent: Apr. 4, 1995

[54] METHOD OF CONNECTING SCREENED MULTICORE CABLES TO A CONNECTOR BODY

[75] Inventor: Gerrard G. Farmer, Dorset, England

[73] Assignee: Westland Helicopters Limited, Somerset, England

[21] Appl. No.: 184,192

[22] Filed: Jan. 18, 1994

[30] Foreign Application Priority Data

Jan. 18, 1993 [GB] United Kingdom ..... 9300843

[51] Int. Cl.[6] ..... H01R 43/04

[52] U.S. Cl. ..... 29/861; 156/53; 156/56; 174/108; 174/109

[58] Field of Search ..... 156/53, 56; 174/108, 174/109; 29/861

[56] References Cited

U.S. PATENT DOCUMENTS 4,187,391 2/1980 Voser ..... 156/56 X
4,694,122 9/1987 Visser ..... 156/53 X
4,749,420 6/1988 Phillips et al. ..... 156/53
4,830,628 5/1989 Dyson et al. .
5,169,344 12/1992 Farmer et al. .

FOREIGN PATENT DOCUMENTS 5-24745 2/1993 Japan ..... 156/53
2199198 6/1988 United Kingdom .

*Primary Examiner*—Carl J. Arbes
*Attorney, Agent, or Firm*—Larson & Taylor

[57] ABSTRACT

An electrically conductive ribbon is wound into contact with the screen of each of a plurality of individual conductors in a multicore cable and is passed through a continuous boundary aperture in the tubular body portion of a backshell which is rotated to wind the ribbon about the cable until the ribbon tightly fills the space between the ribbon wound portion of the cable and the internal surface of the body portion to anchor the cable to the tubular body portion. The free end of the ribbon is then severed substantially flush with the external surface of the tubular body portion.

5 Claims, 1 Drawing Sheet

METHOD OF CONNECTING SCREENED MULTICORE CABLES TO A CONNECTOR BODY

BACKGROUND OF THE INVENTION

1. Field of the Invention

This invention concerns the connection of multicore cables having a plurality of individual conductor screens to a connector body. The multicore cables to which the invention is applicable may have an individual electrically conductive screen for each conductor or individual electrically conductive screens may be provided for respective groups of conductors. The screened conductors or groups of conductors may be arranged within a collective screen.

2. Description of the Prior Art

Various proposals have been made for effecting connections between such a multicore cable and a connector body with provision for anchoring the conductor screens relatively to the connector body so as to miniraise mechanical loading of the cable conductors and, especially, to achieve electrical bonding of the individual screens to one another and to the connector body or a component associated therewith. In general these proposals involve the employment of a backshell having provision both for securing the cable in a manner to transmit mechanical loads and for obtaining electrical continuity between itself and the conductor screens of the cable.

One such proposal is represented by GB-A-2199198 that discloses a backshell having a cylindrical tubular body portion which in one embodiment includes an integral cylindrical end portion having a slot extending from one end and generally parallel to a longitudinal axis. The slot receives one end of an electrically conductive ribbon that is wound about the cable and in contact with the individual conductor screens. The end portion of the body is provided with an external coarse thread to receive an internally threaded termination nut which serves to trap a free end of the ribbon to provide good electrical continuity and axial restraint. The disclosed construction is complex and the requirement for the separate termination nut increases the weight.

In our co-pending application no. 9027024.0 (GB-A-2239358) we have disclosed backshell constructions that overcome certain problems of the prior art devices and that in preferred embodiments are simpler and lighter than the prior devices such as that exemplified by GB-A-2199198. The preferred backshell construction includes an electrically conductive tubular member having at least one aperture in the form of a hole having a continuous boundary. In use of this backshell construction, the individual conductor screens of the cable are exposed over a predetermined length of the latter and an electrically conductive ribbon is wound into contact with the corresponding portions of the length of each exposed conductor screen to provide a ribbon-wound portion of the length of the cable. The tubular member of the backshell is then positioned over the cable with the aperture in registration with the ribbon-wound portion of the cable length and the ribbon is passed through that aperture; the tubular member is then rotated relatively to the cable to wind the ribbon about the cable, whereafter the free end of the ribbon is wound about the exterior of the tubular member and secured in place as by a cable strap.

It is disclosed in our said application that when the tubular member of the backshell has apertures in the form of holes of appropriate dimensions, the wound ribbon tends to bulge into said holes to interfere with relative longitudinal motion between the cable and the tubular member. When the free end of the ribbon is wound about the tubular member and secured as with a cable strap, this portion of the ribbon bulges inwardly into the holes and engages the bulged portion of the ribbon within the tubular member to provide cable clamping and an efficient strain relief function.

We have now discovered that with a tubular member of appropriate configuration, winding of the ribbon about the cable until the wound ribbon tightly fills the space between the cable and the internal surface of the tubular member can in itself provide electrical continuity and sufficient anchorage for the cable to prevent its withdrawal from the tubular member, without the need for the free end of the ribbon to be wound about the exterior of the tubular member and to be secured thereto.

SUMMARY OF THE INVENTION

Accordingly, the present invention provides a method of connecting a multicore cable having a plurality of individual conductor screens to a connector using a backshell comprising an electrically-conductive tubular body portion having at least one continuous boundary aperture, said method comprising:

- exposing each of said individual conductor screens over a predetermined length of the cable;
- winding an electrically-conductive ribbon into contact with corresponding portions of the length of each said conductor screen to provide a ribbon-wound portion of the length of the cable;
- positioning said tubular body portion over said cable with an aperture in said body portion in registration with the ribbon-wound portion of the cable length, and passing said ribbon through said aperture;
- rotating said tubular body portion relatively to the cable, thereby to wind said ribbon about the cable, until the wound ribbon tightly fills the space between the ribbon-wound portion of the cable length and the internal surface of the tubular body portion, to at least assist anchorage of the cable against longitudinal withdrawal from the tubular body portion;
- and severing the free end of the ribbon substantially flush with the external surface of the tubular body portion.

If desired, following severing of the free end of the ribbon, the tubular body portion may be further rotated relatively to the cable so as to position the ribbon end out of register with the or any aperture of said body portion.

Desirably the tubular body portion is shaped to cooperate with the wound ribbon filling the said space so as to anchor the cable against longitudinal motion relatively to the tubular body portion in either direction. This shaping may be provided, at least in part, by the provision of a plurality of apertures arranged circumferentially about the tubular body portion and dimensioned and disposed so as to permit at least a central region of the wound ribbon tightly filling the said space to bulge into the said apertures to a substantial extent.

Preferably, said plurality of apertures comprise four substantially circular holes.

BRIEF DESCRIPTION OF THE DRAWINGS

The invention will be further described with reference to the accompanying drawings in which.

DETAILED DESCRIPTION OF THE DRAWINGS

Figure 1:
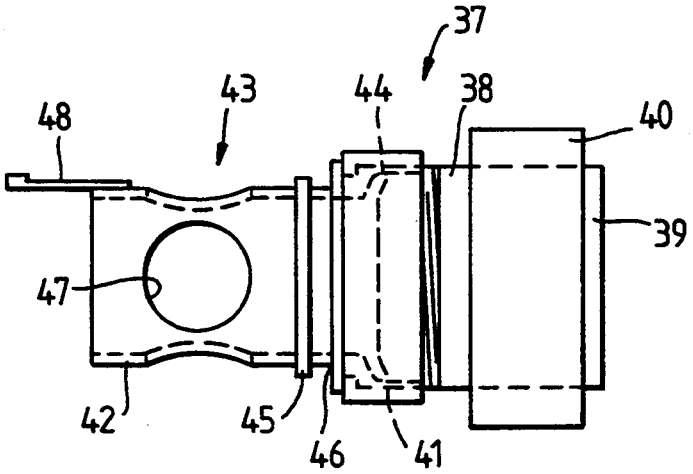
FIG. 1 is a side view of a cylindrical connector incorporating a backshell suitable for use in the method of the invention.

Referring to the drawings, FIG. 1 shows a connector 37 including a generally cylindrical connector body 38 having a multi-pin connector 39 at one end thereof adapted to receive the ends of individual conductors of a multicore cable in known manner. A relatively rotatable coupling nut 40 is located on the connector body 38 and, in use, facilitates the attachment of the connector 37 to apparatus (not shown) to which the cable is to be connected via a mating connector part.

The other end of the connector body 38 is threaded externally to receive an internally threaded end of a coupling nut 41 freely rotatable on one end of a tubular body portion 42 of a backshell 43. When fully engaged, anti-rotation teeth 44 on adjacent ends of connector body 38 and backshell body 42 prevent relative rotation of the parts. A radially extending lip 45 defines a groove 46 at an inner end of tubular body 42 for engagement during operation by an inner end of a protective sleeve or boot (not shown).

In this embodiment the tubular body portion 42 of the backshell has continuous boundary apertures in the form of four circular holes 47 equi-spaced circumferentially therearound, and a strain relief post 48 extends from an end of the tubular body portion 42 to provide an anchor for a cable strap that prevents chafing of the cable at its entry to the backshell.

In connecting a multicore cable to the illustrated connector in accordance with the method of the invention, the cable end is prepared in the usual manner to permit the individual conductors to be crimped or otherwise secured to connector elements (pins or sockets) that are fitted to the connector body 38, leaving the individual conductor screens exposed for a suitable length that in the assembled construction will be located within the backshell 43. During this operation the backshell is separated from the connector body 38 to provide the required access.

An electrically-conductive braid or like ribbon is wound amongst the exposed individual screens to as to make good electrical contact with each, and about the exterior of the cable so as to provide a ribbon-wound portion of the cable length. The free end of the ribbon is passed outwardly of the tubular body portion 42, through one of the holes 47.

The tubular body portion 42 is then rotated relatively to the connector body 38, and the cable connected thereto, so as thereby to wind the ribbon about the cable. this rotation is continued until the wound ribbon tightly fills the space between the cable and the internal surface of the tubular body portion 42 to provide good electrical connection, and bulges outwardly into each of the holes 47 to an extent sufficient to anchor the cable firmly against longitudinal motion relatively to the backshell. In this embodiment effective anchorage is obtained by suitable choice of the size and number of the holes 47 in relation to the diameter of the tubular body portion 42. In the illustrated embodiment there are, as previously described, four holes 47 equispaced around the tubular body portion 42; in other embodiments there may be fewer or more holes. Holes having a continuous boundary but of other than circular shape, e.g. oval or rectangular, may be used.

In a backshell of the configuration illustrated and in which the tubular body portion 42 has an external diameter of about 25 mm, the circular holes 47 may have diameters of about 15 mm. When used with a braid ribbon having a nominal width of 13 mm, the holes span the entire width of the ribbon to allow it to bulge freely into each hole, without constraint due to trapping its marginal portions.

When the ribbon has been wound about the cable to the point at which further rotation of the tubular body portion 42 is seriously impeded by the bulging of the wound ribbon into the holes 47, the free end of the ribbon is severed substantially flush with the external surface of the tubular body portion 42. If desired a small amount of further rotation of the tubular body portion 42 may then be effected to carry the severed end of the ribbon into the body portion and out of register with any of the holes 47. However, for most applications, and especially when an external sleeve or boot is to be fitted over the backshell, this will be unnecessary.

Finally the backshell 43 is fully connected to the connector body 38 by tightening of the coupling nut 41, the anti-rotation teeth 44 being thereby engaged. Any required sleeve or boot is then fitted in conventional manner.

Figure 2:
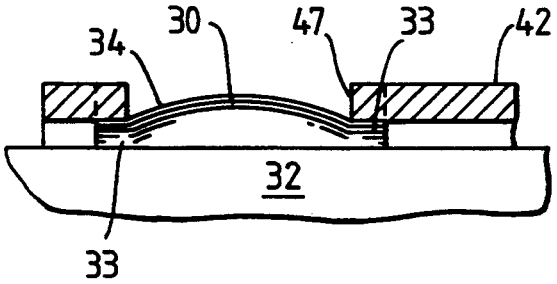
FIG. 2 is a fragmentary side view of part of FIG. 1, on an enlarged scale.

FIG. 2 illustrates the manner in which the wound ribbon anchors the cable to the tubular body portion 42 of the backshell. In this Figure the cable is illustrated at 32 and the ribbon at 30, the sectional view of the body portion being taken in a plane displaced from a diameter of a hole 47 by notional rotation about the axis of tubular body portion 42. Thus this Figure shows the ribbon with portions 33 tightly compressed and filling the space between the cable 32 and the internal surface of the tubular body portion 42 to provide an effective radio frequency (RF) current path from the conductor screens of the cable 32 to the tubular body portion 42. Although not revealed by FIG. 2, it will be understood that in the regions between the holes 47, the full width of the ribbon 30 will be compressed like the portions 33. However, the ribbon being formed as a braid is resilient under compression and in the regions where it is not restrained by engagement with the internal surface of the tubular body portion 42, that is to say within the area of each of the holes 47, bulges outwardly as shown at 34. This bulging of the ribbon into the holes 47 provides substantial interference between the body portion 42 and the ribbon and effectively prevents relative longitudinal motion in either direction between the cable 32 and the tubular body portion 42.

While the invention has been disclosed in its application to a cylindrical connector, it should be understood that the method is equally applicable to connectors of other forms, such as ARINC 404 type connectors in the form disclosed in our said copending application (GB-A-2239358). Moreover, the interior of the tubular body portion 42 may be shaped—e.g. by the provision of internal ribs or shoulders—to engage the ribbon edges and supplement the anchorage effect of the ribbon bulging into the apertures.

What is claimed is:

1. Method of connecting a multicore cable having a plurality of individual conductor screens to a connector using a backshell comprising an electrically-conductive tubular body portion having at least one continuous boundary aperture, said method comprising:

exposing each of said individual conductor screens over a predetermined length of the cable;

winding an electrically-conductive ribbon into contact with corresponding portions of the length of each said conductor screen to provide a ribbon-wound portion of the length of the cable;

positioning said tubular body portion over said cable with an aperture in said body portion in registration with the ribbon-wound portion of the cable length, and passing said ribbon through said aperture;

rotating said tubular body portion relatively to the cable, thereby to wind said ribbon about the cable, until the wound ribbon tightly fills the space between the ribbon-wound portion of the cable length and the internal surface of the tubular body portion, to at least assist anchorage of the cable against longitudinal withdrawal from the tubular body portion;

and severing the free end of the ribbon substantially flush with the external surface of the tubular body portion.

2. A method according to claim 1, further comprising rotating said tubular body portion relatively to the cable, after severing the free end of the ribbon, to position the ribbon end out of register with the or any aperture of said body portion.

3. A method according to claim 1, in which said tubular body portion is shaped to cooperate with the wound ribbon filling said space so as to anchor the cable against longitudinal motion relatively to said body portion.

4. A method according to claim 3, in which said tubular body portion has a plurality of apertures arranged circumferentially thereabout and dimensioned and disposed to permit at least a central region of the wound ribbon rightly filling said space to bulge into the apertures.

5. A method according to claim 4, wherein said plurality of apertures comprise four substantially circular holes.

* * * * *